US005101750A

United States Patent [19]

Dumas

[11] Patent Number: 5,101,750

[45] Date of Patent: Apr. 7, 1992

[54] TANKER SHIP HULL FOR REDUCING CARGO SPILLAGE

[76] Inventor: Allen E. Dumas, 1250 Oakhill Rd., Keller, Tex. 76248

[21] Appl. No.: 584,622

[22] Filed: Sep. 19, 1990

[51] Int. Cl.[5] ..... B63B 25/12

[52] U.S. Cl. ..... 114/74 R; 220/564

[58] Field of Search ..... 114/74 R, 74 A, 74 T, 114/256; 220/4.14, 501, 563, 564

[56] References Cited

U.S. PATENT DOCUMENTS 4,241,683 12/1980 Conway ..... 114/74 R

FOREIGN PATENT DOCUMENTS 2118091 11/1971 Fed. Rep. of Germany .... 114/74 R 106351 5/1917 United Kingdom ..... 114/74 R

*Primary Examiner*—Sherman D. Basinger

*Attorney, Agent, or Firm*—Geoffrey A. Mantooth

[57] ABSTRACT

A tanker is divided into multiple cargo tanks for carrying liquid cargo such as oil. Each tank has a top wall, a bottom wall and side walls. Each tank is provided with a generally horizontal wall that divides the tank into upper and lower zones. The upper zone is located between the horizontal wall and the top wall, while the lower zone is located between the horizontal wall and the bottom wall. The horizontal wall is located near the water line of the tanker and is oil tight so as to eliminate the head pressure of the oil in the tank in the event the lower zone is ruptured.

5 Claims, 4 Drawing Sheets

TANKER SHIP HULL FOR REDUCING CARGO SPILLAGE

FIELD OF THE INVENTION

The present invention relates to those types of ships referred to as tankers that carry liquid cargo such as petroleum oil and the like.

BACKGROUND OF THE INVENTION

Much of this country's energy needs are met with oil, both domestically produced and imported from foreign countries. Furthermore, oil is used as a raw material in many manufactured goods and materials, such as plastics.

Much of this oil is transported from place to place in tankers. Tankers are used to ship oil from Alaska to the continental United States. Tankers are also used, among other things, to ship oil between the Gulf, West and East coasts. In addition, the tankers are used to import oil from foreign countries.

Oil spills from tankers in and near ports have happened in the past and will likely continue in the future. Unlike tankers operating on the high seas, where they are subjected mainly to wind and wave forces, tankers operating in and around ports are subjected to high density shipping traffic, limited maneuvering room and natural hazards such as reefs, shifting bottoms, etc.

Oil spills near coastlines have grave environmental consequences, resulting in large scale wildlife kills, fouled beaches, estuaries and water bottoms. Oil spills also have grave economic consequences as evidenced by Exxon spending over one billion dollars to clean up after the Exxon Valdez ran aground in Alaska.

It is plainly clear that the technology needed to effectively clean up an oil spill is sorely lacking. Containment booms and skimmers, even if deployed timely, are unable to contain a major spill. Surfactants merely make the problem disappear from view by causing the oil to sink to the bottom, where it interferes with bottom life. Microbes have recently proven satisfactory, but only on small portions of spills.

The most effective solution is to limit the amount of oil that is spilled into the water once a tanker's cargo tanks have been ruptured. Double hull construction is one way to limit oil spills. In tankers equipped will a double hull, the bottom and the sides of the tanker have two walls between the sea and the cargo. Although this construction makes it more difficult to breach the cargo tanks, a breach is still possible.

SUMMARY OF THE INVENTION

It is an object of the present invention to provide a means for reducing the amount of oil spilled from breached cargo tanks in a tanker.

The tanker of the present invention has a hull with tanks that are adapted to carry liquid cargo. Each tank includes a top wall, a bottom wall and side walls. Each tank also includes a horizontal wall that divides the tank into upper and lower zones. The upper zone is between the top wall and the horizontal wall and the lower zone is between the horizontal wall and the bottom wall. The horizontal wall is located at a water line of the tanker. In each of the tanks the upper and lower zones are isolated from each other by the horizontal wall such that if the lower zone is ruptured, cargo from the upper zone is prevented from moving into the lower zone by the horizontal wall.

By locating the horizontal wall at or near the water line of the tanker, the wall removes the head pressure of the oil that is above the water line from acting on the oil below the water line. Thus, when the tank is ruptured, the oil in the upper zone is prevented from pushing oil out of the tank through the rupture. The only oil that is spilled is that oil that is located at and below the rupture. Should the rupture occur at the bottom of the tank, then very little oil would be spilled. The velocity of the oil that does escape through the rupture is greatly reduced because the head pressure of the oil is eliminated. This means less oil will be lost before emergency crews and equipment are in place to control the spill.

DESCRIPTION OF PREFERRED EMBODIMENT

Figure 1:
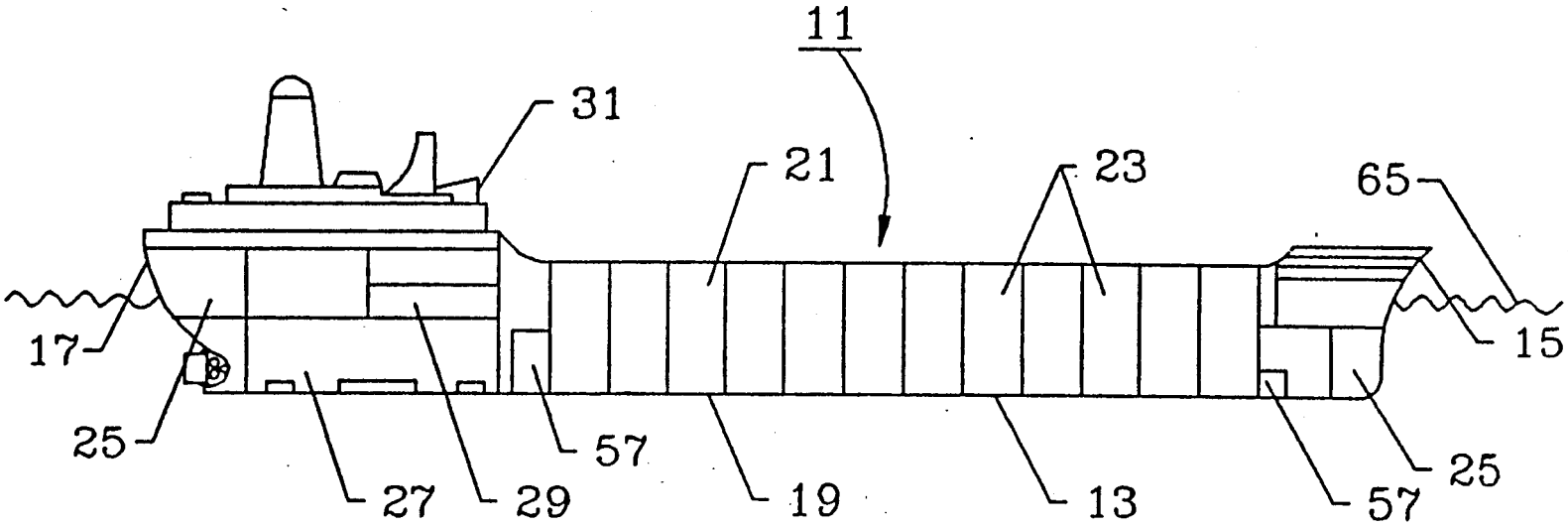
FIG. 1 is a schematic longitudinal side cross-sectional view of a tanker.

In FIG. 1, there is shown a tanker 11. The tanker 11 has a hull 13 with a bow 15, a stern 17, a bottom 19 and sides 21. The tanker 11 has multiple tanks 23 for carrying liquid cargo such as crude oil and oil products. In addition, the tanker has plural ballast tanks, including fore and aft tanks 25. The aft portion of the tanker has the engine room 27, crew quarters 29 and the bridge 31.

The number and size of cargo tanks 23 depends on the type of tanker. The tanks are typically arranged in ordered longitudinal and transverse fashion. The port tanks 23A extend longitudinally along the port side of the tanks, the center tanks 23B extend along the center line, and the starboard tanks 23C extend along the starboard side.

Figure 2:
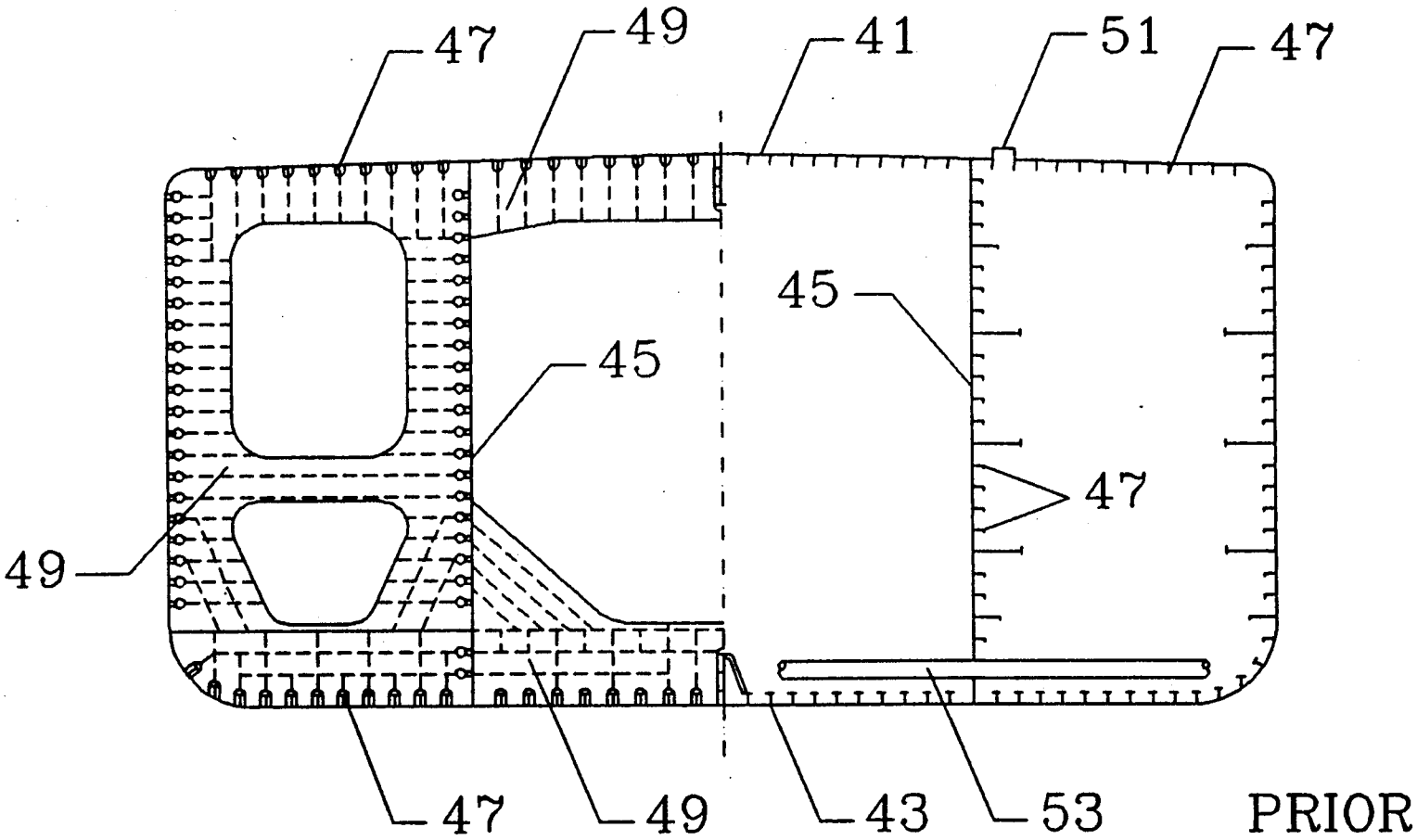
FIG. 2 is a schematic transverse plan cross-sectional view of the tanker, showing side transverses on the left side of the drawing.

Referring to FIG. 2, each tank 23 is generally rectangular, having a top wall 41 (the deck of the tanker), a bottom wall 43 (the bottom of the hull), and four side walls 45. The side walls 45 are typically vertical bulkheads that are common to the two respective adjacent tanks. The side wall bulkheads 45 are watertight (or oiltight) and serve to separate the respective tanks from each other. One of the side walls in the port and starboard tanks is the side 21 of the hull. In double bottom tankers, the tanks are isolated from the hull bottom by an interior bulkhead. The deck 41 of the tanker, which serves as the top wall of the cargo tanks 23, is typically slanted, being high along the center line and tapering downwardly to the sides 21 of the tanker. This configuration enables the deck to shed water more easily.

Longitudinal stiffeners 47 or beams run the length of each tank. The longitudinal stiffeners 47 extend beneath the deck 41, on top of the hull bottom 43 (in single bottom tankers) and along the hull sides 21 and partitioning bulkheads 45. The longitudinal stiffeners 47 along the tank bottom are larger in dimension than the stiffeners along the top, because of the greater pressures and forces encountered at the tank bottom. Side transverses 49 are provided in the tanks for strength and bracing. The side transverses 49 are large plates that are coupled to the top, bottom and side walls 41, 43, 45 of a tank. The side transverses are perpendicular to the longitudinal stiffeners 47. Large openings allow oil to pass therethrough.

Each tank 23 is provided with a hatch 51 in the deck 41, providing access to the interior of the tank. In addition, each tank is provided with conventional piping 53 and valves for loading and discharging cargo. The piping is routed to the pump rooms 57. Depending on the types of products the tanker is designed to carry, heating coils may be provided in the tanks to reduce the viscosity of the cargo in transit. Other special equipment may also be provided.

For safety reasons, the tanker 11 is provided with sufficient reserve buoyancy to ensure flotation in all types of seas. This reserve buoyancy is provided by locating the deck 41 at some distance above the water 59 (see FIG. 3). This distance, between the deck 41 and the surface of the water 65, is referred to as the freeboard of the ship. The tanker always has some freeboard, even when the cargo tanks are fully loaded.

As a matter of standard practice, the cargo tanks 23 are loaded at less than full capacity. This leaves a gap 61 or an air space between the top of the oil cargo 62 and the top wall 41 of the tank, which gap is referred to as ullage. In some tankers, the ullage space 61 is filled with inert gas, such as the exhaust from the engines, to minimize the fire hazard.

Figure 3:
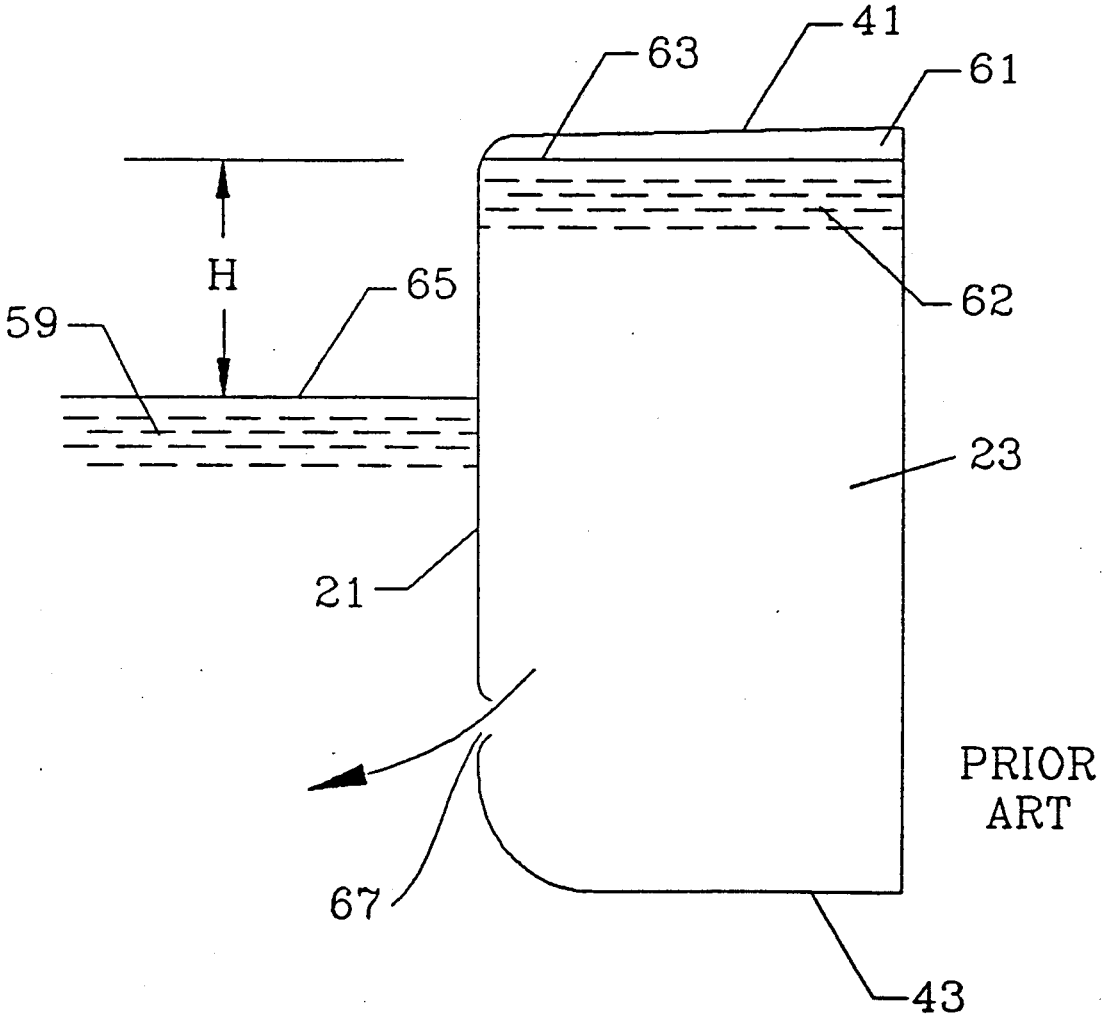
FIG. 3 is a schematic cross-sectional side view of a prior art tank.

Even with the ullage space 61, the top level 63 of the cargo is typically above the water line 65 of the tanker. This distance H, from the top level 63 of the cargo in a tank to the water line 65, is referred to herein as the head of cargo. The head of cargo H may vary from tank to tank, depending on the ullage in the particular tank. In small ships, of about 20,000 dead weight tons (DWT), the freeboard may be 10 feet. If the ullage is 1½-2 feet, then the head of cargo H is 8-8½ feet. For large ships (160,000 DWT) having a freeboard of 18-20 feet, the head of cargo H may be 16-18 feet. The head of cargo in a tank becomes important when the tank is breached or ruptured. As shown in FIG. 3, an opening 67 in the tank 23 allows the cargo oil to escape. Because the cargo has a head H that is above the water line 65, the cargo will be pushed out of the opening 67 by the head pressure. This head pressure diminishes to zero when the level of cargo approaches the water line. After the head pressure becomes zero, the only cargo that escapes from the tank will be due to displacement by the exterior water 59. Thus, a volume of oil approximately equal to the head of cargo times the tank area is lost overboard as a result of the head pressure of the cargo.

Figure 4:
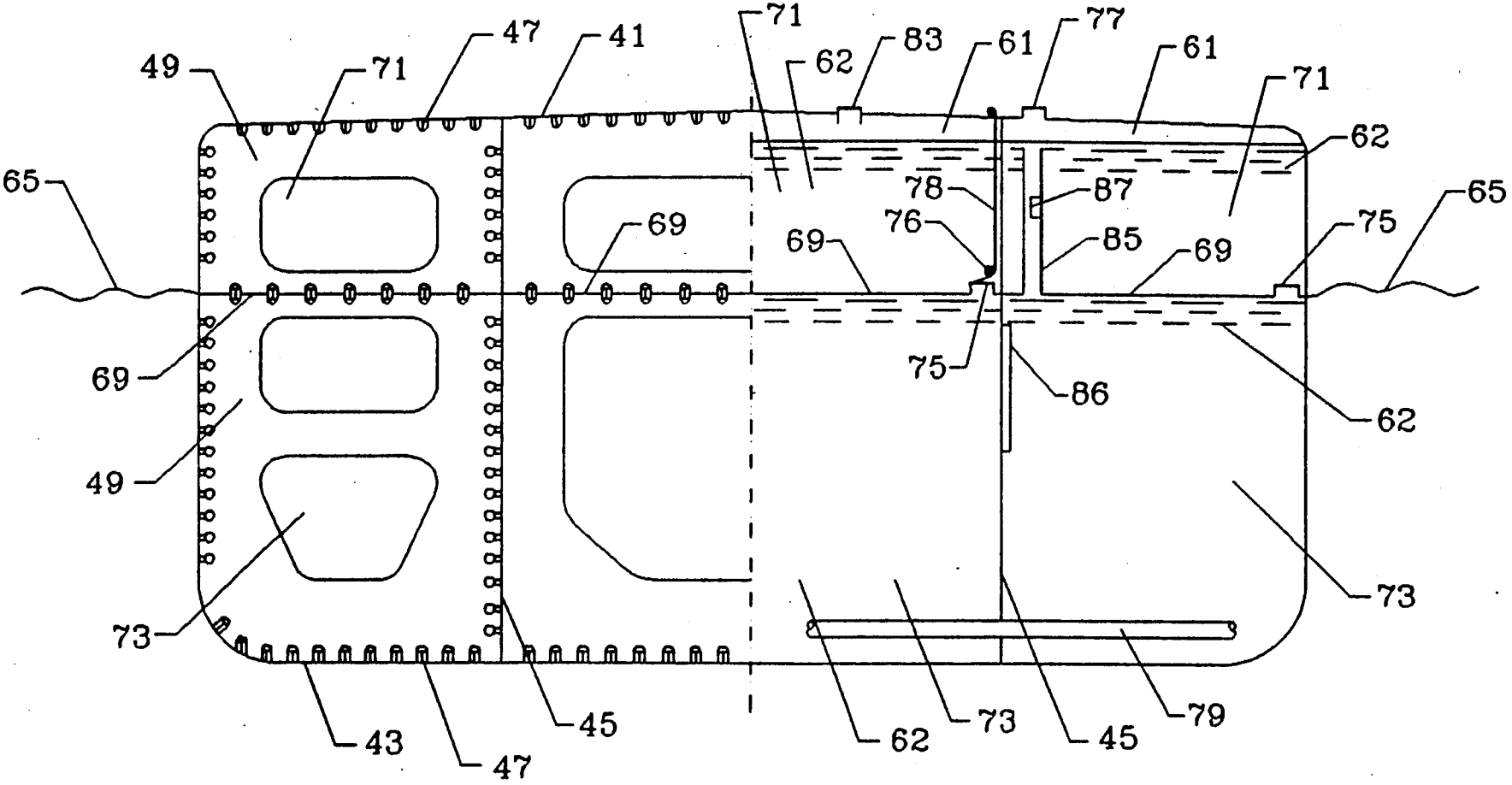
FIG. 4 is a schematic cross-sectional side view of a tank of the present invention, in accordance with a preferred embodiment.

The present invention provides means for preventing oil leakage due to the head pressure caused by the head of cargo. Referring to FIG. 4, the present invention provides a horizontal wall 69 or bulkhead in each tank 23. The wall 69, which is located at or near the water level 65 is oil tight so as to divide the tank into two zones. The upper zone 71 is located between the wall 69 and the deck 41, while the lower zone 73 is located between the wall 69 and the bottom 43. The two zones are isolated from each other by the rigid wall 69, so that if a puncture occurs in the lower zone, the oil in the lower zone 73 is not subjected to any head pressure by the upper zone. Thus, the only leakage that occurs is due to the displacement of the oil 62 by the water 59. The only oil that is displaced by the water 59 is that oil that is located below the breach 57. Should the breach 67 occur at or near the bottom wall 43 of the tank, then little or no oil will escape.

The wall 69 is coupled to all of the side walls 45 in the tank 23 so as to be oil tight and to prevent leakage from the upper zone 71 to the lower zone 73. The wall is generally horizontal, having a slight slope to allow for drainage during tank washup and to allow for venting of gasses in the lower zone 73. The wall is adequately braced in a manner similar to the deck 41 by longitudinal stiffeners 47 and side transverses 49. Side transverses 49 are provided in both upper and lower zones. The side transverses in the upper zones are aligned with the side transverses in the lower zones, for better load bearing capability. The wall 69 is located at the water line 65 of the tanker when the tanker is loaded. The water line on a tanker will vary according to the amount and type of cargo that is carried. A fully loaded tanker will ride lower in the water than a partially loaded one. Some cargos, such as heavy crudes, are more dense than other cargos, causing the water line to be higher. Furthermore, the type of water (salt or fresh) and water temperature that the tanker is sailing in affect the water line of a tanker. This is evidenced by the Plimsoll lines that are marked on the outside of the hull of tankers. Thus, the wall is located somewhere within the range of possible water lines, so as to be at, near or slightly below the anticipated water line during a voyage.

A hatch 75 is provided in the wall 69 to allow crew members to access the lower zone 73 from the upper zone 71. The hatch 75 is oil tight when closed. The hatch 75 is open during the loading and unloading of cargo into the upper and lower zones 71, 73. The hatch 75, which is located at the lowest point of the wall 69, provides a passage for air to exit and enter the lower zone 73 during loading and unloading. The hatch 75 is closed by gravity and is opened remotely from the deck 41 by a system of pulleys 76 and cable 78. The weight of the oil in the upper zone 71 is sufficient to seal the hatch, thereby eliminating the need for a locking mechanism on the hatch 75. The upper zone has a hatch 77 that provides access to it from the deck 41. Both zones have piping 79 for loading and discharging cargo.

A pipe 85 provides a passage between the upper and lower zones 71, 73 in each tank 23 to allow for expansion and contraction of the cargo in the lower zone during transit. The pipe 85 has an upper end and a lower end. The lower end is flush with the bottom surface of the wall 69 and is located at the highest point of the sloped wall 69. The upper end of the pipe 85 is located at or near the estimated top level of the cargo in the upper zone 71. This prevents the cargo in the upper zone from flowing into the lower zone through the pipe 85, in the event the lower zone is breached. As the cargo in the lower zone 73 expands, it flows upwardly through the pipe 85 and into the upper zone 71. As the cargo in the lower zone contracts, it draws cargo from the upper zone 71 through the pipe 85 to the lower zone, if the upper end of the pipe is located at or below the top level of the upper zone of cargo.

Means are provided for gauging the ullage in both the upper and lower zones. A conventional ullage hatch 83 is used to gauge the ullage in the upper zone 71. Remote ullage sensors 86 are used to gauge the ullage in the lower zone 73.

In loading the tanks 23, the lower zone 73 is loaded with cargo first. The lower zone 73 is filled completely full of cargo, so that cargo flows into the upper zone 71 by way of the open hatch 75. Any gasses in the lower zone will escape by the pipe 85. Then, the upper zone is filled to the desirable ullage level 61.

In the event the lower zone 73 is breached, the level of oil in the pipe 85, which is above the waterline 65, will quickly fall to its static pressure point. A conventional sensor 87, such as a float device, is located inside of the pipe 85 to remotely monitor the presence or absence of oil in the pipe 85 at a location above the static pressure point. The sensor is thus located above the waterline 65. Thus, the pipe 85 and the sensor 87 can be used to monitor both the occurrence and location of a breach. Knowing which tank is breached allows the crew to begin discharging cargo from the breached lower zone into another tank, such as a ballast tank, thereby minimizing the amount of spilled cargo.

With the tanker of the present invention, the amount of oil lost overboard in the event of a tank rupture is greatly reduced. This is because the wall virtually eliminates the head pressure that would, in prior art tankers, act to force oil out of the ruptured tank.

Furthermore, the structural soundness of the tanker is increased by the provision of the wall 69. The tanker hull is strengthened in both the longitudinal and transverse directions. Further still, in the event of an oil spill accident, the stability of the tanker is greatly improved. The oil in the upper zone would remain intact. The oil in the lower zone, if it left the tank, would be replaced by water. Thus, a load imbalance would be minimized, reducing the risk of severe listing or even capsizing of the tanker.

The wall can be used on a double hulled or double bottomed tanker. The integrity of the cargo tanks can never be assured, even with a double hulled tanker. With the wall 69, the amount of oil spilled in the event of a rupture of the inner hull would be minimized. Furthermore, the wall of the present invention can be retrofitted onto existing tankers.

The foregoing disclosure and the showings made in the drawings are merely illustrative of the principles of this invention and are not to be interpreted in a limiting sense.

I claim:

1. In a tanker ship having a hull with tanks that are adapted to carry liquid cargo, each of said tanks comprising a top wall, a bottom wall and side walls; the improvement comprising a horizontal wall in each of said tanks, said horizontal wall in each tank dividing said tank into upper and lower zones, with said upper zone being between said top wall and said horizontal wall and said lower zone being between said horizontal wall and said bottom wall; said horizontal wall being located at a water line of said tanker; in each of said tanks, said upper and lower zones being isolated from each other such that if said tank lower zone is breached, cargo from said upper zone is prevented from moving into said lower zone by said horizontal wall; and further comprising means for allowing the expansion and contraction of cargo in each of said lower zones, said expansion and contraction means comprising a passageway between said respective upper zone and said respective lower zone, said passageway allowing for the flow of cargo between said respective upper and lower zones such that when said cargo in said lower zone expands, some cargo from said lower zone flows into said upper zone, and when said cargo in said lower zone contracts, some cargo in said upper zone flows into said lower zone, said passageway maintaining the isolation of said upper zone from said lower zone if said lower zone is breached.

2. The tanker of claim 1 wherein each of said expansion and contraction means comprises a pipe having an upper end and a lower end, said lower end having a lower opening located in said respective lower zone, said upper end having an upper opening located in said respective upper zone near the top level of cargo in said upper zone.

3. The tanker of claim 2 further comprising sensor means for sensing the presence or absence of cargo; there being a sensor means located in each of said passageways above the waterline of said tanker, wherein said sensor means provide an indication of a breach and the particular tank that is breached.

4. A tanker ship, comprising:

a) multiple tanks adapted for carrying liquid cargo, each of said tanks extending above and below a water line of said tanker;

b) each of said tanks having an oil tight wall that divides each tank into upper and lower zones, said upper zone being above said wall and said lower zone being below said wall, said wall being located near a water line of said tanker, said upper zone being isolated from said lower zone wherein if said lower zone is ruptured then cargo in said upper zone is prevented from moving into said lower zone by said wall;

c) support means for supporting said oil tight wall, said support means comprising longitudinal stiffeners and side transverses;

d) a passageway between said respective upper and lower zones for allowing the expansion and contraction of cargo in said lower zones, each passageway having an upper end and a lower end, said lower end having a lower opening located in said respective lower zone, said upper end having an upper opening located in said respective upper zone near the top level of cargo in said upper zone.

5. The tanker ship of claim 4 wherein each of said oil tight walls has a slight slope, said respective passageway lower ends being located at a high point on said respective wall.

* * * * *